US007896337B2

(12) United States Patent
Kumadaki

(10) Patent No.: US 7,896,337 B2
(45) Date of Patent: Mar. 1, 2011

(54) IMAGE FORMING APPARATUS AND PAPER FEEDING METHOD

(75) Inventor: Kazuhiro Kumadaki, Fukuoka (JP)

(73) Assignee: Panasonic Corporation, Osaka (JP)

( * ) Notice: Subject to any disclaimer, the term of this patent is extended or adjusted under 35 U.S.C. 154(b) by 819 days.

(21) Appl. No.: 11/865,840

(22) Filed: Oct. 2, 2007

(65) Prior Publication Data

US 2008/0216690 A1 Sep. 11, 2008

(30) Foreign Application Priority Data

Oct. 3, 2006 (JP) ..... 2006-271513

(51) Int. Cl.
*B65H 5/00* (2006.01)

(52) U.S. Cl. ..... 271/10.04; 271/10.02; 271/10.12; 271/10.13; 271/242

(58) Field of Classification Search ... 271/10.02–10.04, 271/10.11–10.13, 227, 242
See application file for complete search history.

(56) References Cited

U.S. PATENT DOCUMENTS 4,071,295 A * 1/1978 Komori et al. ..... 399/394
4,529,188 A * 7/1985 Sturnick ..... 271/10.12
5,501,444 A * 3/1996 Yukimachi et al. ..... 271/127
5,642,952 A 7/1997 Tomatsu et al.
6,983,122 B2 1/2006 Hayamizu et al.

FOREIGN PATENT DOCUMENTS

JP 6-135589 5/1994
JP 9-211921 8/1997
JP 9-216754 8/1997

OTHER PUBLICATIONS

English language Abstract of JP 6-135589.
English language Abstract of JP 9-216754.
English language Abstract of JP 9-211921.

* cited by examiner

*Primary Examiner*—Stefanos Karmis
*Assistant Examiner*—Jeremy Severson
(74) *Attorney, Agent, or Firm*—Greenblum & Bernstein P.L.C.

(57) ABSTRACT

An image forming apparatus includes an external gear to which a rotating force of a resist gear is transmitted, a ratchet for transmitting a rotating force from the external gear to a paper feed roller or releasing the transmission, and a ratchet arm having a claw engaged with the ratchet to transmit a rotation of the external gear, thereby rotating the paper feed roller, and a claw engaged with a slit provided on a boss of the paper feed roller to turn the paper feed roller toward a rotation start position and removing the claw from the ratchet to stop the paper feed roller, and the boss is provided with an offset bottom peripheral surface to be moved with the claw entering to stop the rotation of the paper feed roller when a resist sensor detects a tip of a recording paper.

8 Claims, 14 Drawing Sheets

IMAGE FORMING APPARATUS AND PAPER FEEDING METHOD

BACKGROUND

1. Field of the Invention

The present invention relates to an image forming apparatus and a paper feeding method which serve to correct a skew feed to a direction of delivery of a recording paper by a resist system.

2. Related Art

In an image forming apparatus using an electrophotographic process, a tip of a recording paper is aligned by means of a resist roller and the recording paper is then fed to transferring, separating and fixing portions. In this case, the resist roller matches the tip of the paper fed from a cassette or a tray by various separating methods with that of an image and corrects a oblique feed (skew) to a delivery direction. The correction is carried out in the following manner. Before the recording paper is fed to the transfer portion side for a next copy, a paper feed roller pushes the recording paper out of a cassette during a stop of the resist roller to cause a tip of the recording paper to abut on upper and lower contact portions (nip portions) of the resist roller, and furthermore, the recording paper is pushed against the abutting portion by means of the paper feed roller to correct a skew.

In the case of the resist system, the resist roller has the function of synchronizing a delivery speed of the recording paper with a circumferential speed of a photosensitive drum after correcting the skew. Therefore, a rotation is carried out in such a manner that a tip of an image is set in a timing with that of the recording paper, and an image is thus transferred onto the recording paper (for example, see JP-A-6-135589 Publication).

In the image forming apparatus using the resist system, there has been proposed a technique for operating an electromagnetic solenoid to rotate and drive a paper feed roller in order to decrease components of a mechanism for executing a paper feeding operation and an aligning operation of a paper, while bringing a resist clutch into a locking state to transmit a power to a resist roller, turning ON the electromagnetic solenoid again in a short time to unlock the resist clutch, thereby stopping the rotation of the resist roller temporarily when aligning the recording paper (for example, see JP-A-9-216754 Publication).

Furthermore, there has been known an image forming apparatus for turning ON a solenoid, thereby causing one of ends of a control member to enter a groove provided on a support member of a first planetary gear to control a rotation thereof and turning ON/OFF the solenoid, thereby causing the other end of the control member to enter a groove provided on a support member of a second planetary gear to control a rotation thereof (for example, see JP-A-9-211921 Publication). Any of developing sleeves for four colors is rotated.

The image forming apparatus described above (JP-A-6-135589 Publication) stabilizes a delivery and prevents a skew by using a rubber having a surface roughness capable of enhancing an adhesion of a recording paper and a roller in order not to cause the recording paper and the roller to slip. However, it is hard to maintain a high recording paper delivering property by only a material of the resist roller, and wrinkles, buckling and slips are generated on the recording paper.

Moreover, the image forming apparatus according to the (JP-A-9-216754 Publication) serves to decrease components for executing a paper feeding operation and a paper aligning operation and to temporarily stop the rotation of the resist roller. With the structure, even if the number of the components is decreased, an amount of flexure of the recording paper in a nip portion of the resist roller is not constant and wrinkles, buckling and slips cannot be prevented from being generated on the recording paper.

Similarly, the image forming apparatus (JP-A-9-211921 Publication) serves to rotate each developing sleeve of a developing device using a tandem method by utilizing an ON/OFF operation of a solenoid and normal and reverse rotations of a motor in order to form a visible image through toners having four colors of yellow (Y), magenta (M), cyan (C) and black (K). In the same manner as in the (JP-A-9-216754 Publication), wrinkles, buckling and slips of the recording paper cannot be prevented and an excellent recording paper delivering property cannot be maintained.

SUMMARY

Therefore, it is an object of the invention to provide an image forming apparatus and a paper feeding method which can correct a skew and can prevent wrinkles, buckling and slips from being generated on a recording paper.

An image forming apparatus according to the invention comprises a resist roller for aligning a printing start position timing with a position of a tip of a recording paper, a paper feed roller for feeding the recording paper to the resist roller, a resist sensor for detecting the tip of the recording paper fed on a upstream side of the resist roller, a resist gear for transmitting a rotating force from a driving motor to the resist roller, an external gear to which a rotating force of the resist gear is transmitted, an internal gear positioned coaxially with the external gear and serving to transmit a rotating force from the external gear to the paper feed roller, a paper feed roller driving gear mated with the internal gear to rotate the paper feed roller, a ratchet positioned coaxially with the internal gear and serving to transmit a rotation of the external gear to the internal gear or to release the transmission of the rotation, a ratchet arm having a first claw engaged with the ratchet to transmit the rotation of the external gear to the internal gear, thereby rotating the paper feed roller, and a second claw engaged with a first dent portion provided on a boss of the paper feed roller driving gear to turn the paper feed roller toward a rotation start position and to remove the first claw from the ratchet, thereby stopping the rotation of the paper feed roller, and a second dent portion provided with the boss of the paper feed roller driving gear, the second claw entering the second dent portion and moving within the second dent portion, thereby stopping the rotation of the paper feed roller when the resist sensor detects the tip of the recording paper before the paper feed roller carries out one rotation.

Moreover, the invention provides a paper feeding method in an image forming apparatus which includes: a resist roller for aligning a printing start position timing with a position of a tip of a recording paper; a paper feed roller for feeding the recording paper to the resist roller; a resist sensor for detecting the tip of the recording paper fed on a upstream side of the resist roller; a resist gear for transmitting a rotating force from a driving motor to the resist roller; an external gear to which a rotating force of the resist gear is transmitted; an internal gear positioned coaxially with the external gear and serving to transmit a rotating force from the external gear to the paper feed roller; a paper feed roller driving gear mated with the internal gear to rotate the paper feed roller; a ratchet positioned coaxially with the internal gear and serving to transmit a rotation of the external gear to the internal gear or to release the transmission of the rotation; a ratchet arm having a first claw engaged with the ratchet to transmit the rotation of the external gear to the internal gear, thereby rotating the paper feed roller, the ratchet arm having a second claw engaged with a first dent portion provided on a boss of the paper feed roller driving gear to turn the paper feed roller toward a rotation start position and to remove the first claw from the ratchet, thereby stopping the rotation of the paper feed roller; and a second dent portion provided with the boss of the paper feed roller driving gear. The method comprises: entering the second claw into the second dent portion; moving the second claw within the second dent portion; and stopping the rotation of the paper feed roller when the resist sensor detects the tip of the recording paper before the paper feed roller carries out one rotation.

BRIEF DESCRIPTION OF THE DRAWINGS

FIG. 13A is a view for explaining the main part after the restart of the paper feeding operation which is taken along the arrow of A-A in FIG. 2, FIG. 13B is a view for explaining the main part after the restart of the paper feeding operation which is taken along the arrow of B-B in FIG. 2, and FIG. 13C is a view for explaining the main part after the restart of the paper feeding operation which is taken along the arrow of C-C in FIG. 2.

DETAILED DESCRIPTION

First Embodiment

Figure 1:
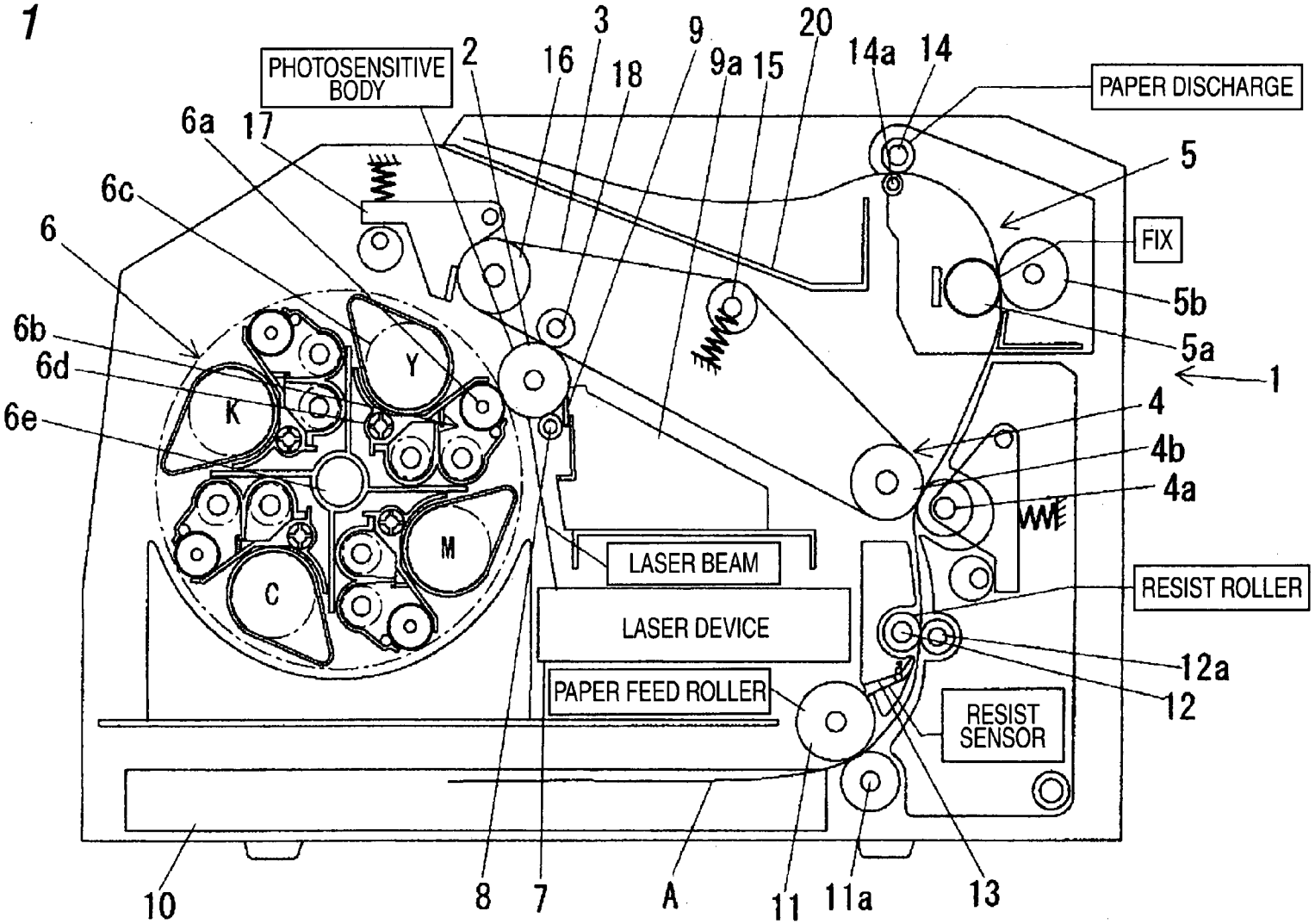
FIG. 1 is a view showing a whole structure of an image forming apparatus according to a first embodiment of the invention.
Figure 2:
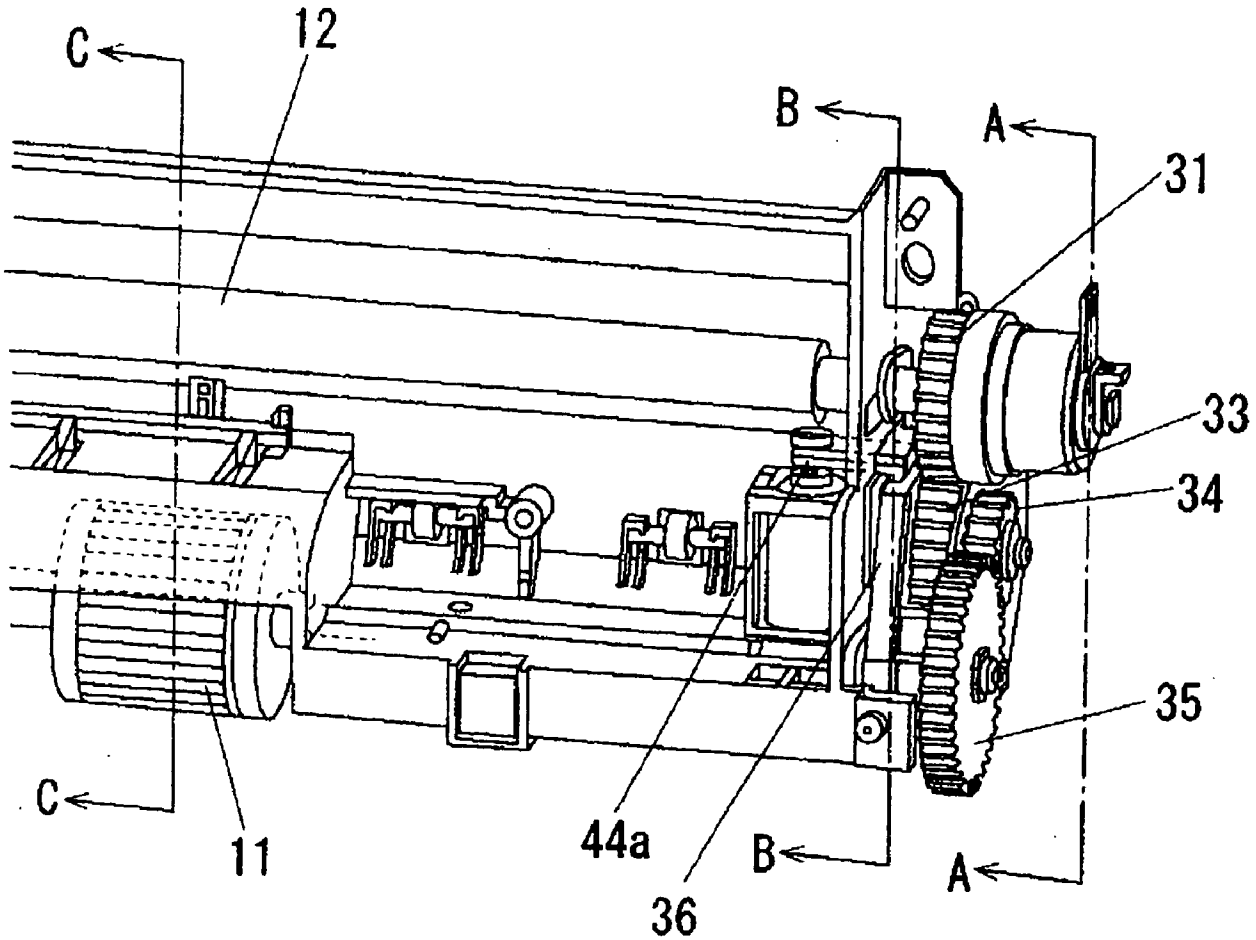
FIG. 2 is a perspective view showing an inner part of the image forming apparatus according to the first embodiment of the invention as seen from a front.
Figure 3:
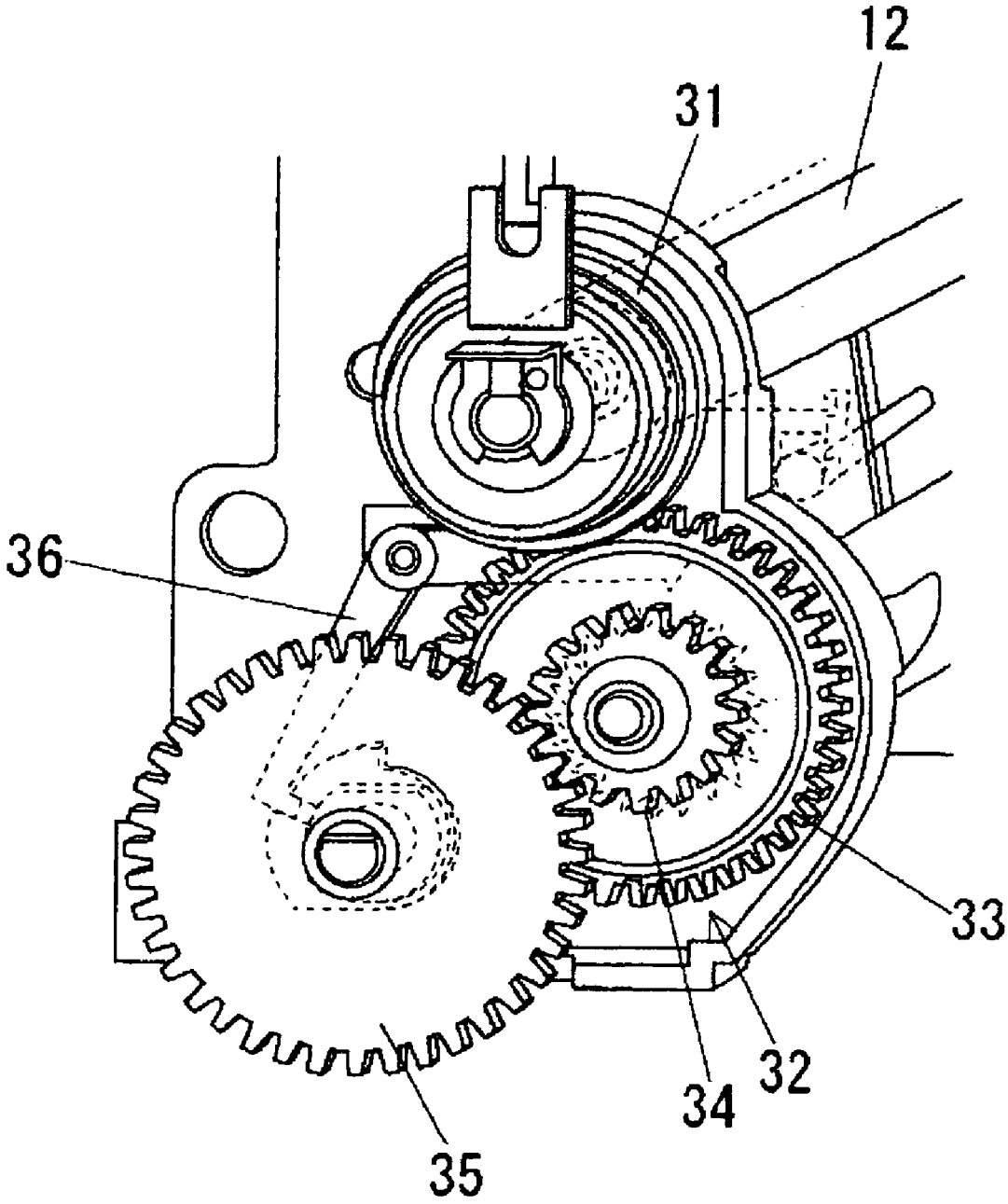
FIG. 3 is a perspective view showing the inner part of the image forming apparatus according to the first embodiment of the invention as seen from a side.
Figure 4:
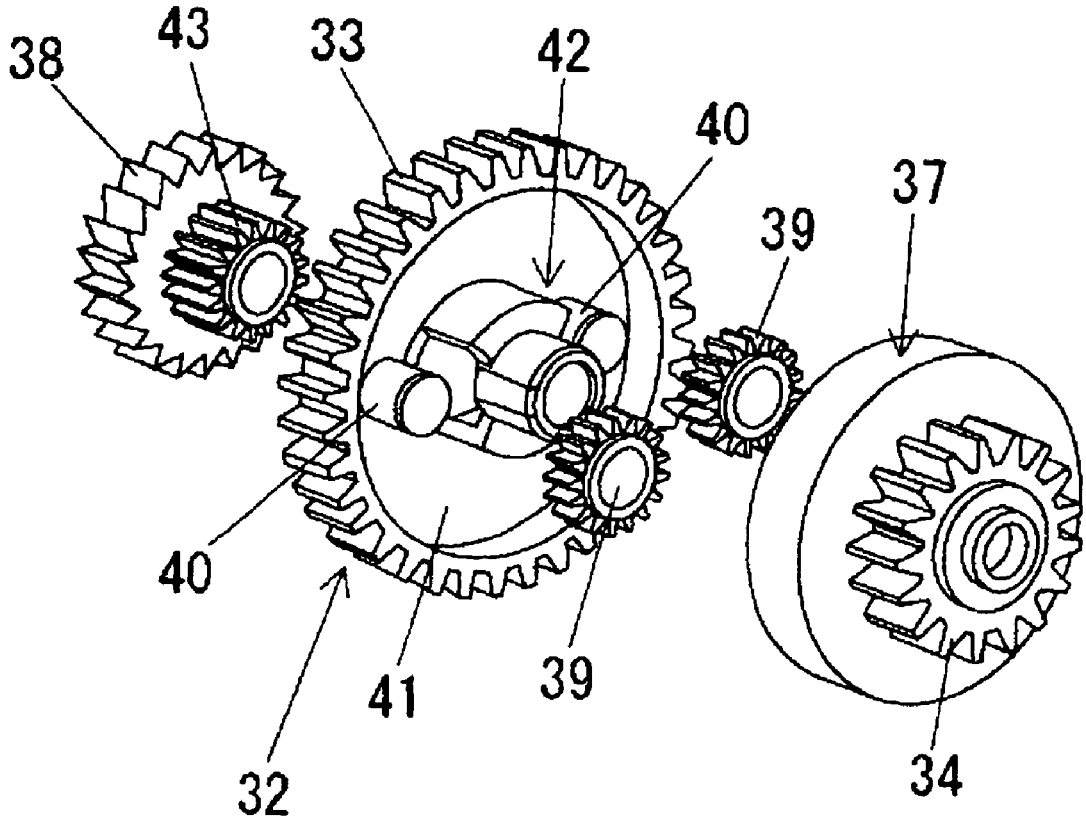
FIG. 4 is an exploded view showing a planetary gear mechanism in the image forming apparatus according to the first embodiment of the invention.
Figure 5:
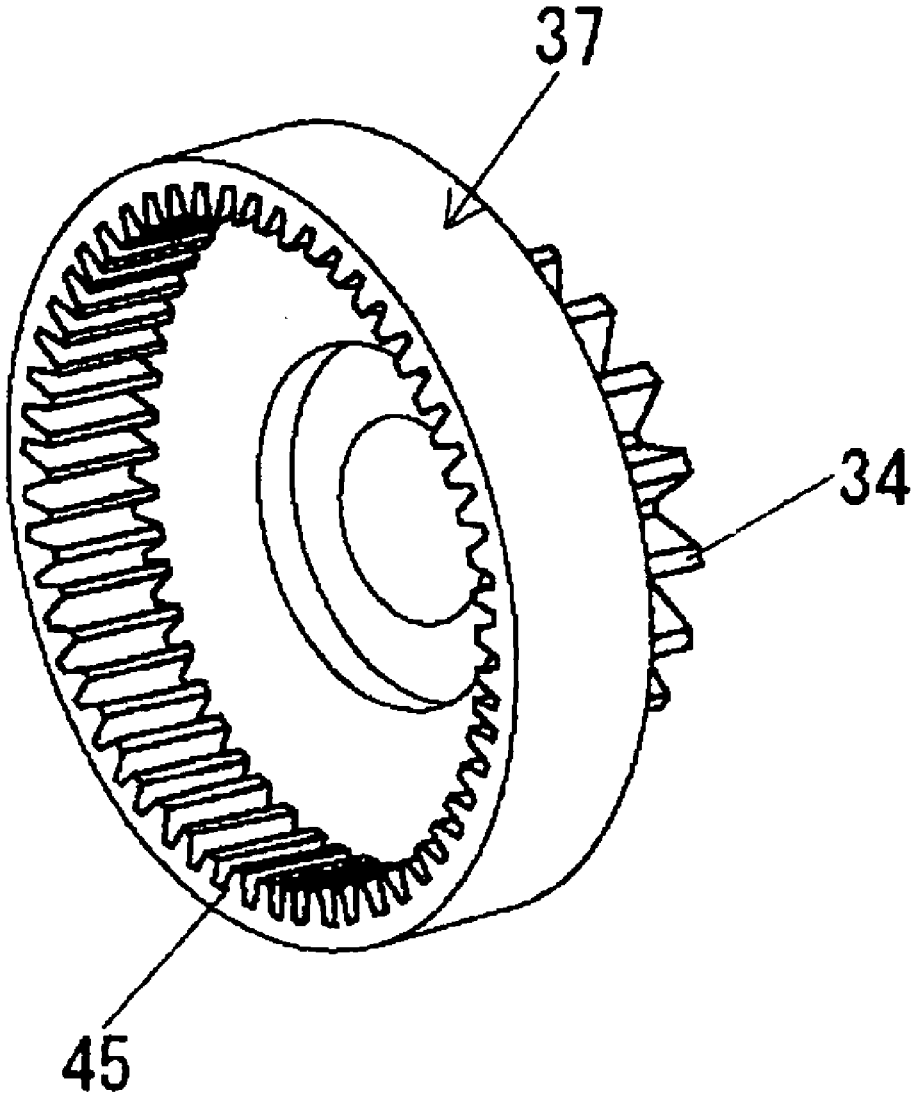
FIG. 5 is a perspective view showing an internal gear in the image forming apparatus according to the first embodiment of the invention.
Figure 6:
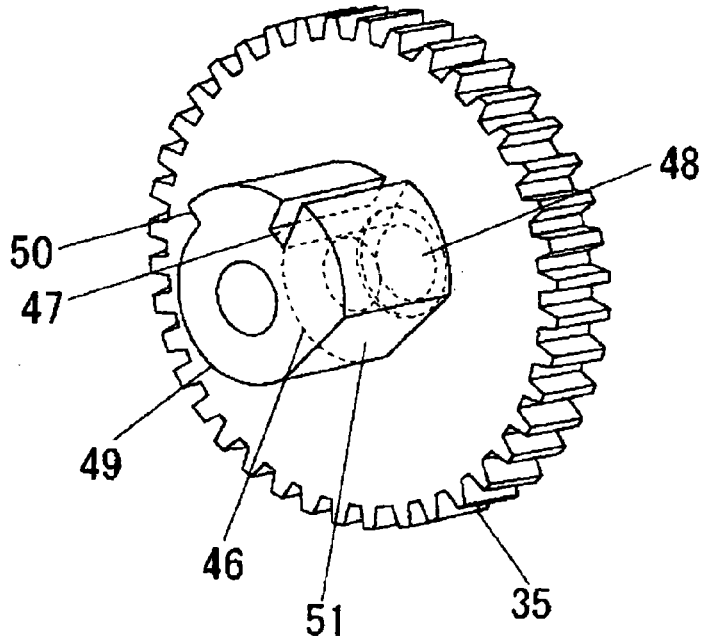
FIG. 6 is a perspective view showing a paper feed roller driving gear in the image forming apparatus according to the first embodiment of the invention.
Figure 7:
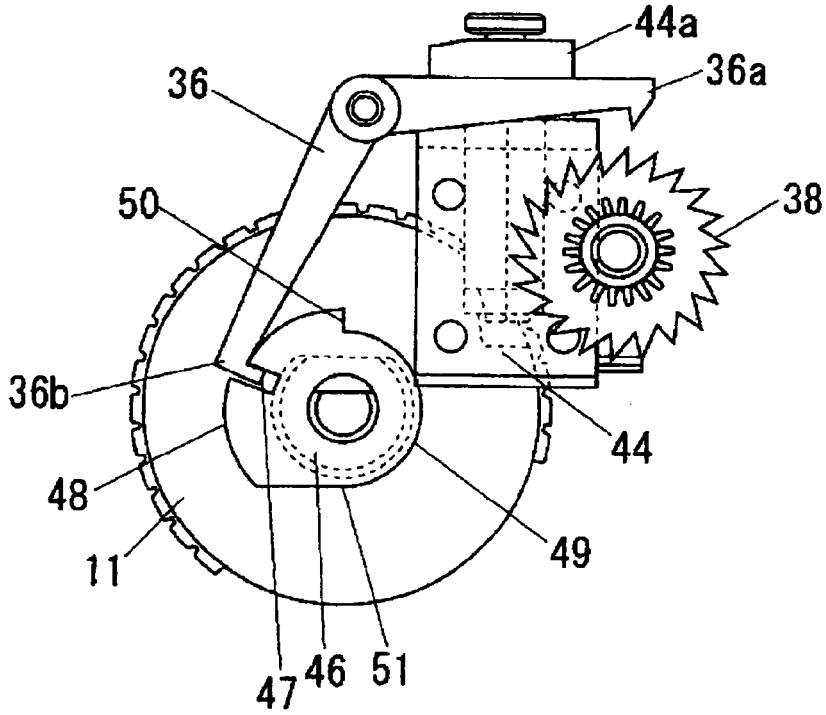
FIG. 7 is a view for explaining the operation of a ratchet mechanism and a paper feed roller driving gear in the image forming apparatus according to the first embodiment of the invention.
Figure 8:
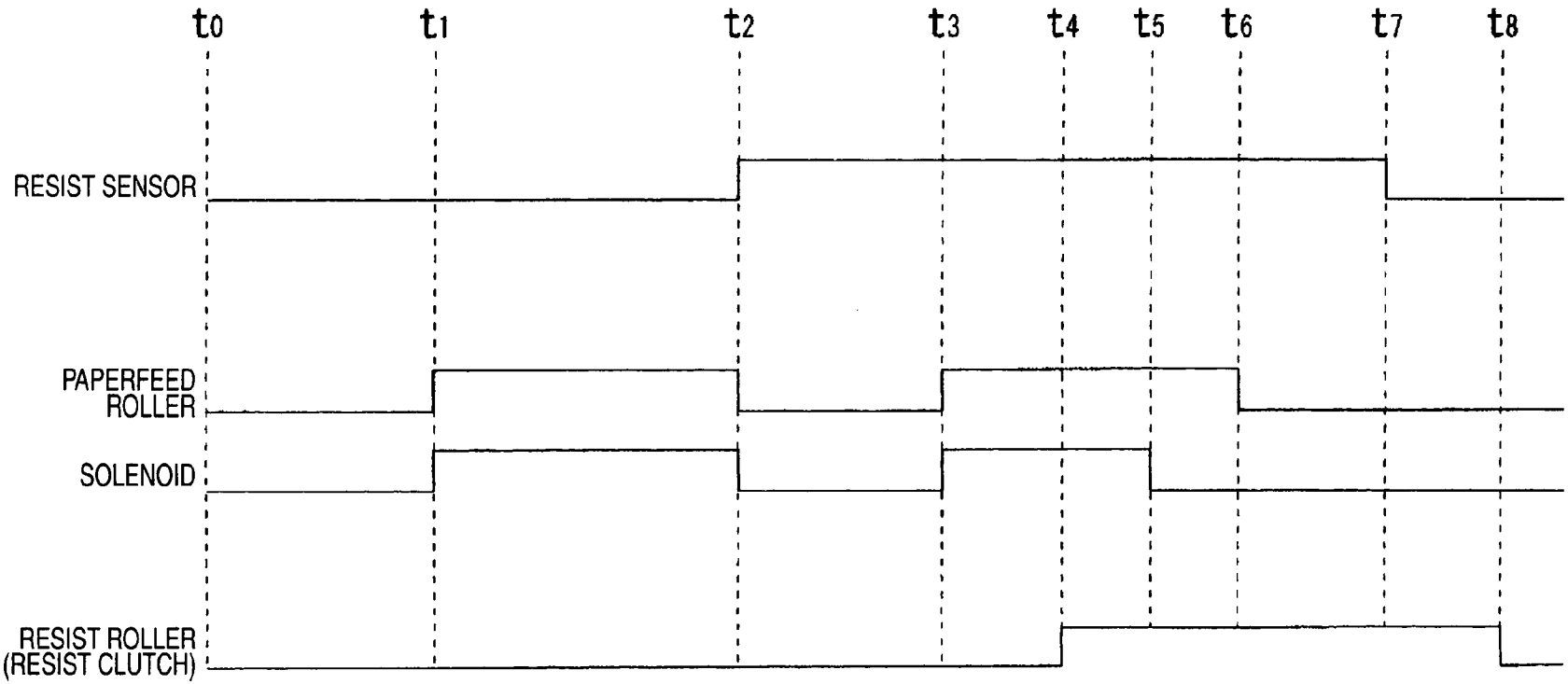
FIG. 8 is a time chart showing a paper feeding mechanism according to the first embodiment of the invention.
Figure 9C:
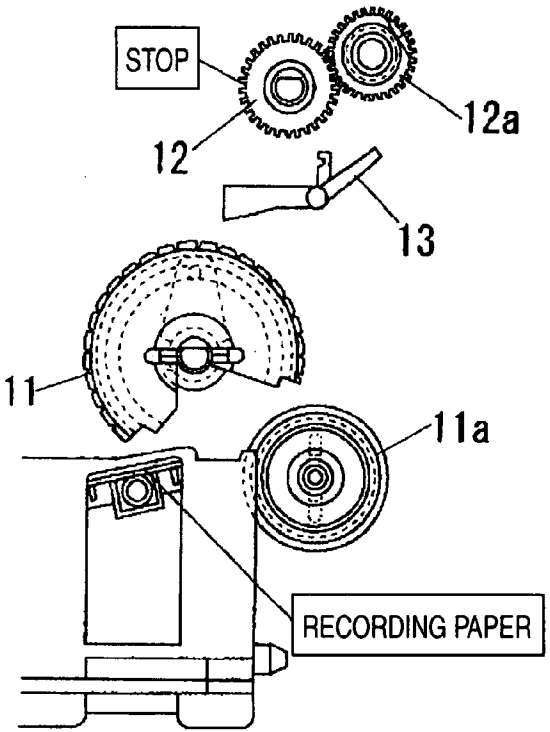
FIG. 9C is a view for explaining the main part before the start of the paper feeding operation which is taken along an arrow of C-C in FIG. 2.
Figure 9B:
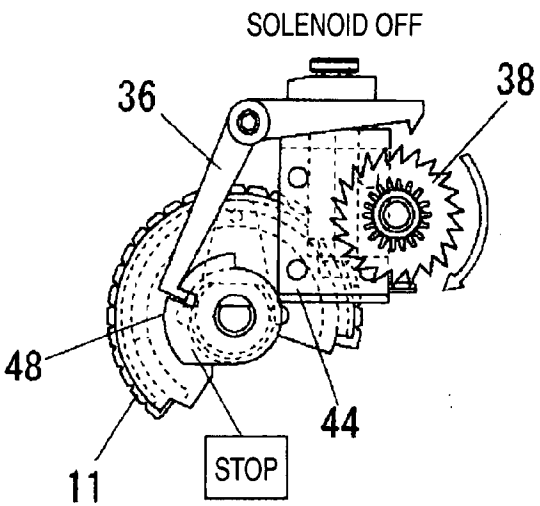
FIG. 9B is a view for explaining the main part before the start of the paper feeding operation which is taken along an arrow of B-B in FIG. 2.
Figure 9A:
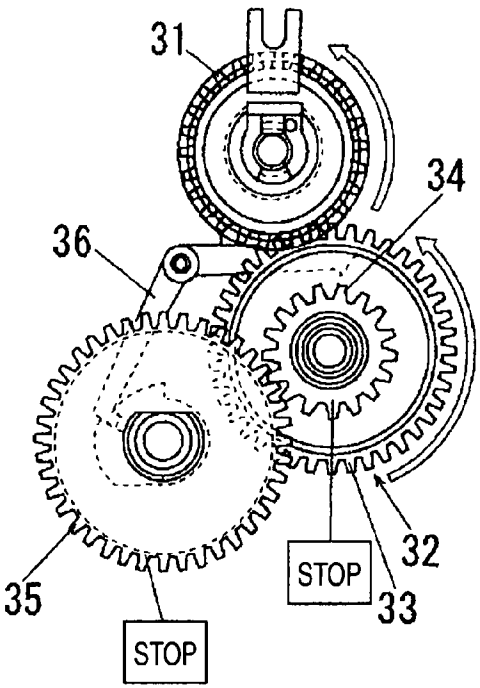
FIG. 9A is a view for explaining a main part before a start of a paper feeding operation which is taken along an arrow of A-A in FIG. 2.
Figure 10C:
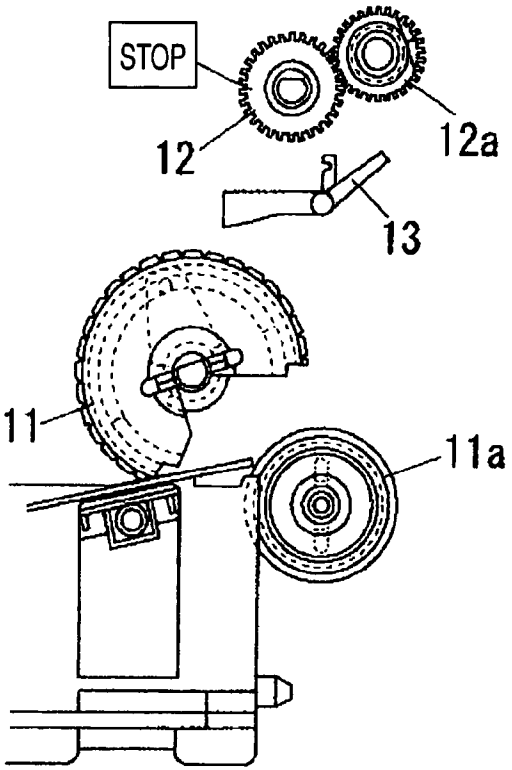
FIG. 10C is a view for explaining the main part immediately after the start of the paper feeding operation which is taken along the arrow of C-C in FIG. 2.
Figure 10B:
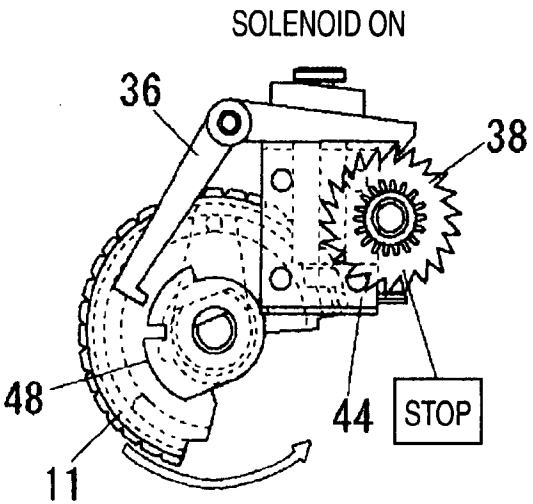
FIG. 10B is a view for explaining the main part immediately after the start of the paper feeding operation which is taken along the arrow of B-B in FIG. 2.
Figure 10A:
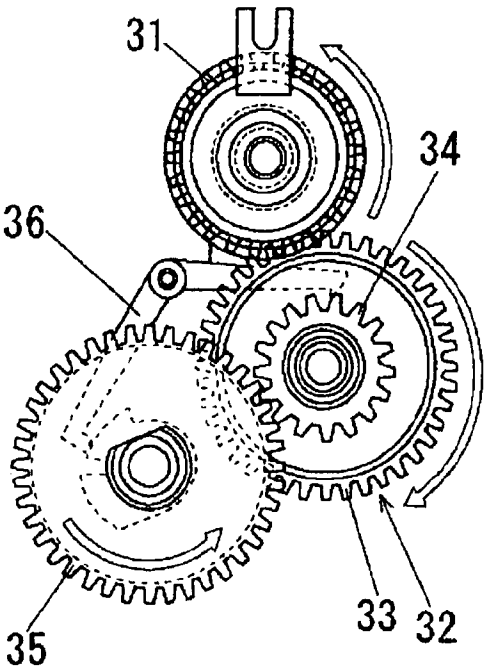
FIG. 10A is a view for explaining the main part immediately after the start of the paper feeding operation which is taken along the arrow of A-A in FIG. 2.
Figure 11C:
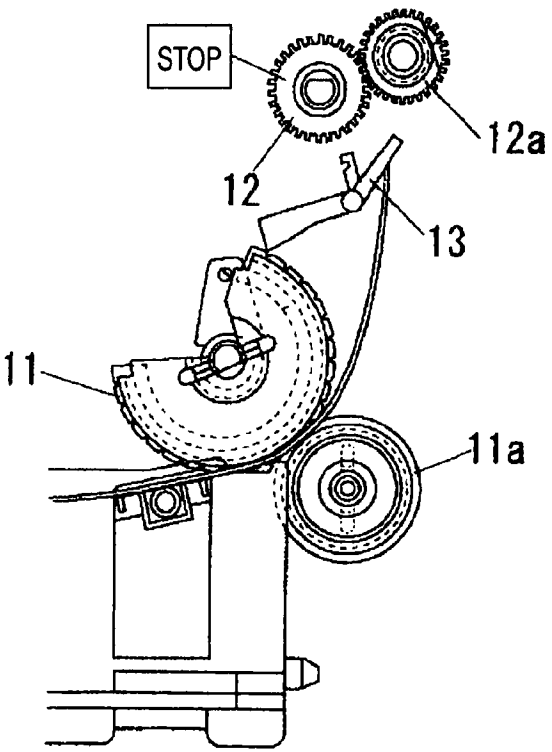
FIG. 11C is a view for explaining the main part in the middle of the paper feeding operation which is taken along the arrow of C-C in FIG. 2.
Figure 11B:
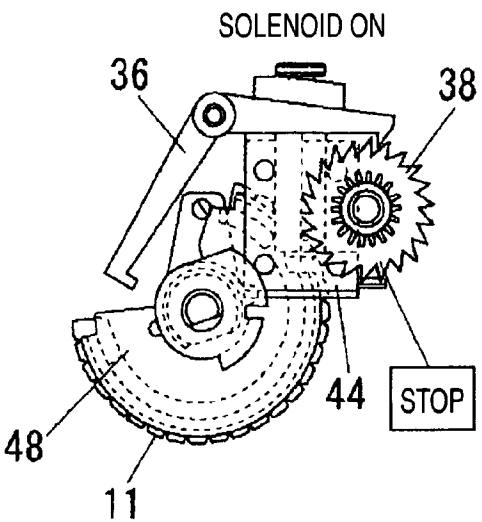
FIG. 11B is a view for explaining the main part in the middle of the paper feeding operation which is taken along the arrow of B-B in FIG. 2.
Figure 11A:
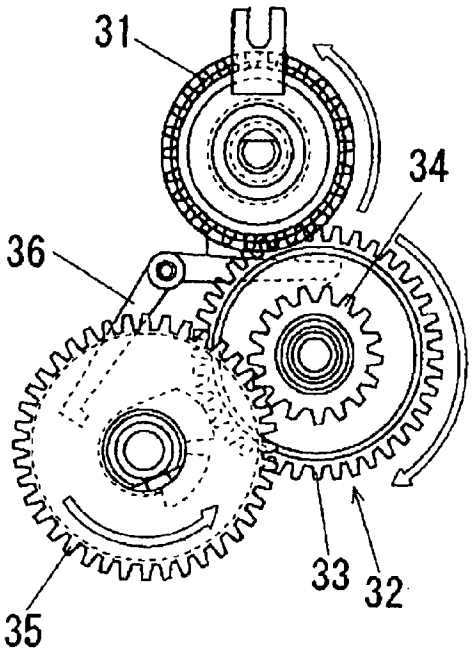
FIG. 11A is a view for explaining the main part in the middle of the paper feeding operation which is taken along the arrow of A-A in FIG. 2.

An image forming apparatus and a paper feeding method according to a first embodiment of the invention will be described below with reference to the drawings. FIG. 1 is a view showing a whole structure of an image forming apparatus according to the first embodiment of the invention, and FIG. 2 is a perspective view showing an inner part of the image forming apparatus according to the first embodiment of the invention as seen from a front. Moreover, FIG. 3 is a perspective view showing the inner part of the image forming apparatus according to the first embodiment of the invention as seen from a side. FIG. 4 is an exploded view showing a planetary gear mechanism in the image forming apparatus according to the first embodiment of the invention, and FIG. 5 is a perspective view showing an internal gear in the image forming apparatus according to the first embodiment of the invention. FIG. 6 is a perspective view showing a paper feed roller driving gear in the image forming apparatus according to the first embodiment of the invention, and FIG. 7 is a view for explaining the operation of a ratchet mechanism and a paper feed roller driving gear in the image forming apparatus according to the first embodiment of the invention, Furthermore, FIG. 8 is a time chart showing a paper feeding mechanism according to the first embodiment of the invention, FIG. 9A is a view for explaining a main part before a start of a paper feeding operation which is taken along an arrow of A-A in FIG. 2, FIG. 9B is a view for explaining the main part before the start of the paper feeding operation which is taken along an arrow of B-B in FIG. 2, and FIG. 9C is a view for explaining the main part before the start of the paper feeding operation which is taken along an arrow of C-C in FIG. 2. Similarly, FIG. 10A is a view for explaining the main part immediately after the start of the paper feeding operation which is taken along the arrow of A-A in FIG. 2, FIG. 10B is a view for explaining the main part immediately after the start of the paper feeding operation which is taken along the arrow of B-B in FIG. 2, and FIG. 10C is a view for explaining the main part immediately after the start of the paper feeding operation which is taken along the arrow of C-C in FIG. 2. Moreover, FIG. 11A is a view for explaining the main part in the middle of the paper feeding operation which is taken along the arrow of A-A in FIG. 2, FIG. 11B is a view for explaining the main part in the middle of the paper feeding operation which is taken along the arrow of B-B in FIG. 2, and FIG. 11C is a view for explaining the main part in the middle of the paper feeding operation which is taken along the arrow of C-C in FIG. 2.

Figure 12C:
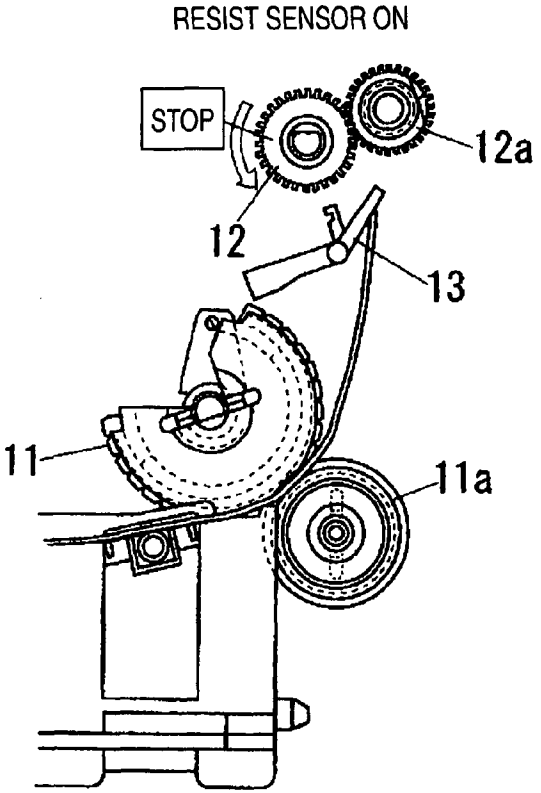
FIG. 12C is a view for explaining the main part at time of the temporary stop of the paper feeding operation which is taken along the arrow of C-C in FIG. 2.
Figure 12B:
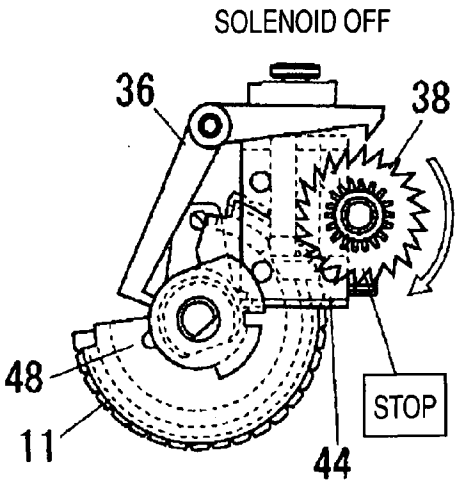
FIG. 12B is a view for explaining the main part at time of the temporary stop of the paper feeding operation which is taken along the arrow of B-B in FIG. 2.
Figure 12A:
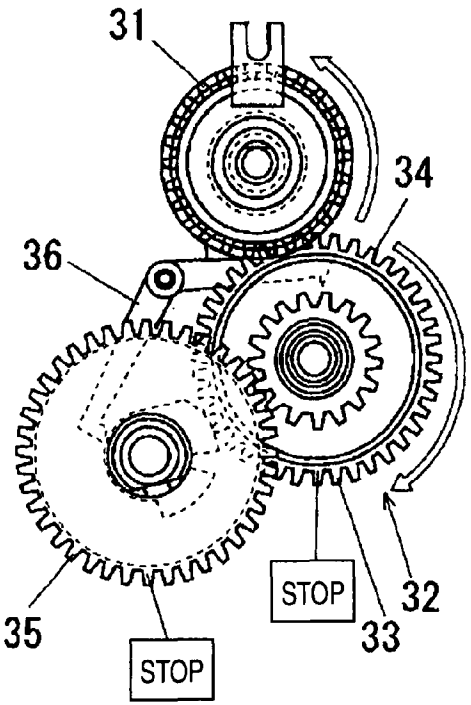
FIG. 12A is a view for explaining the main part at time of a temporary stop of the paper feeding operation which is taken along the arrow of A-A in FIG. 2.
Figure 13C:
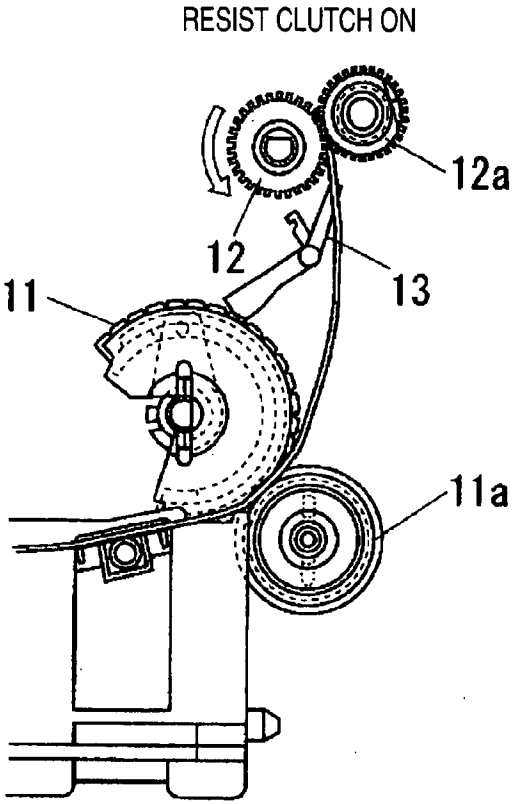
FIG. 13C is a view for explaining the main part at time of the temporary stop of the paper feeding operation which is taken along the arrow of C-C in FIG. 2.
Figure 13B:
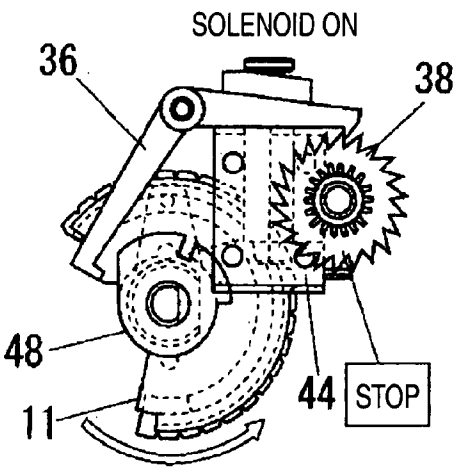
FIG. 13B is a view for explaining the main part at time of the temporary stop of the paper feeding operation which is taken along the arrow of B-B in FIG. 2.
Figure 13A:
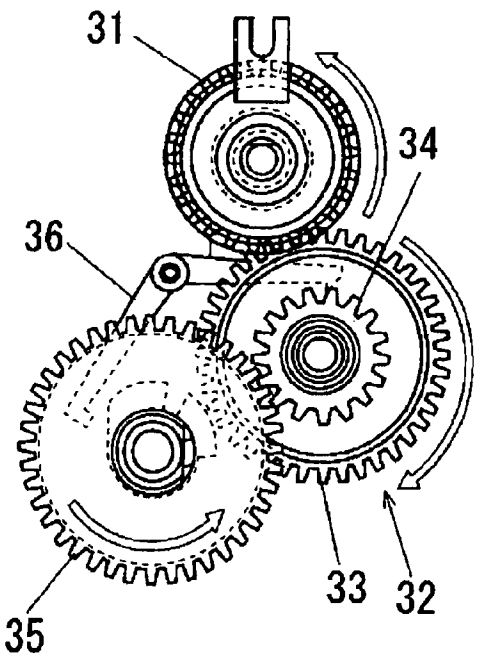
FIG. 13A is a view for explaining the main part after a restart of the paper feeding operation which is taken along the arrow of A-A in FIG. 2.
Figure 14C:
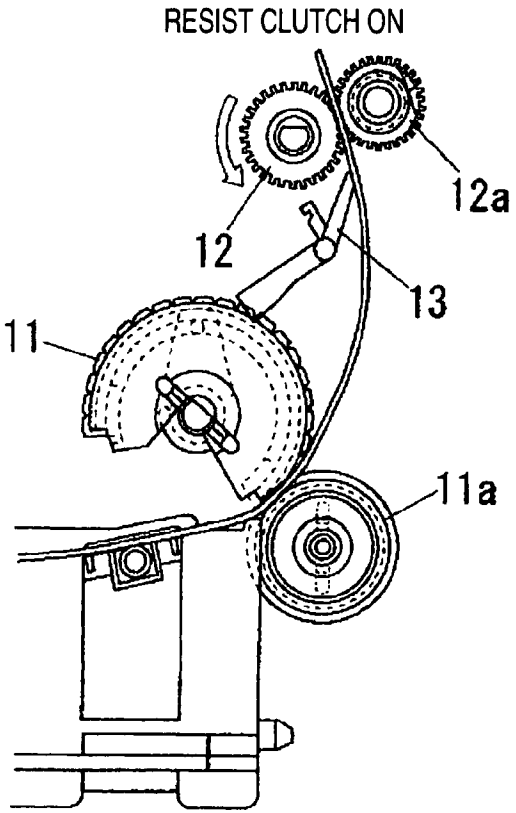
FIG. 14C is a view for explaining the main part immediately before the end of the paper feeding operation which is taken along the arrow of C-C in FIG. 2.
Figure 14B:
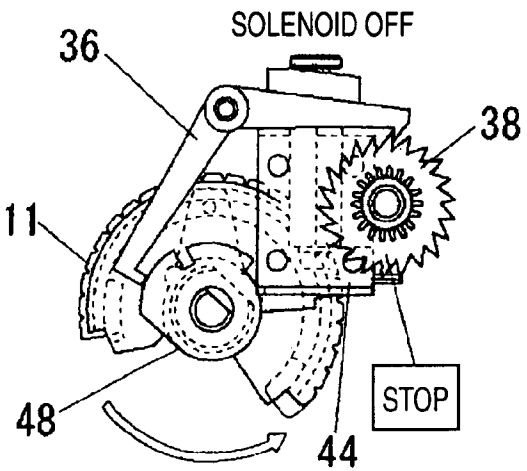
FIG. 14B is a view for explaining the main part immediately before the end of the paper feeding operation which is taken along the arrow of B-B in FIG. 2.
Figure 14A:
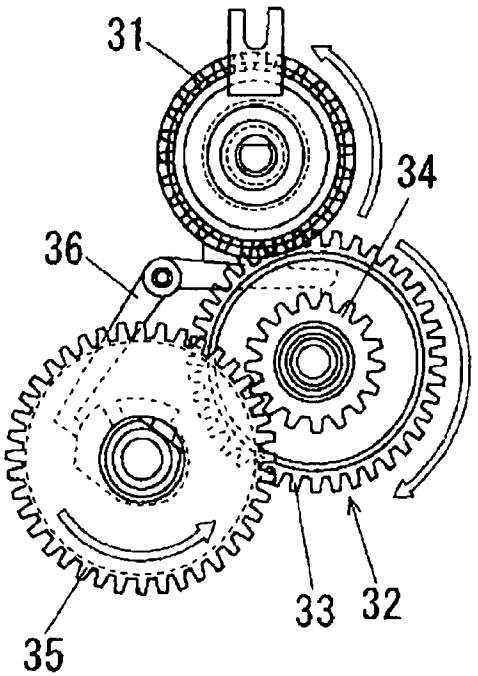
FIG. 14A is a view for explaining the main part immediately before an end of the paper feeding operation which is taken along the arrow of A-A in FIG. 2.
Figure 15:
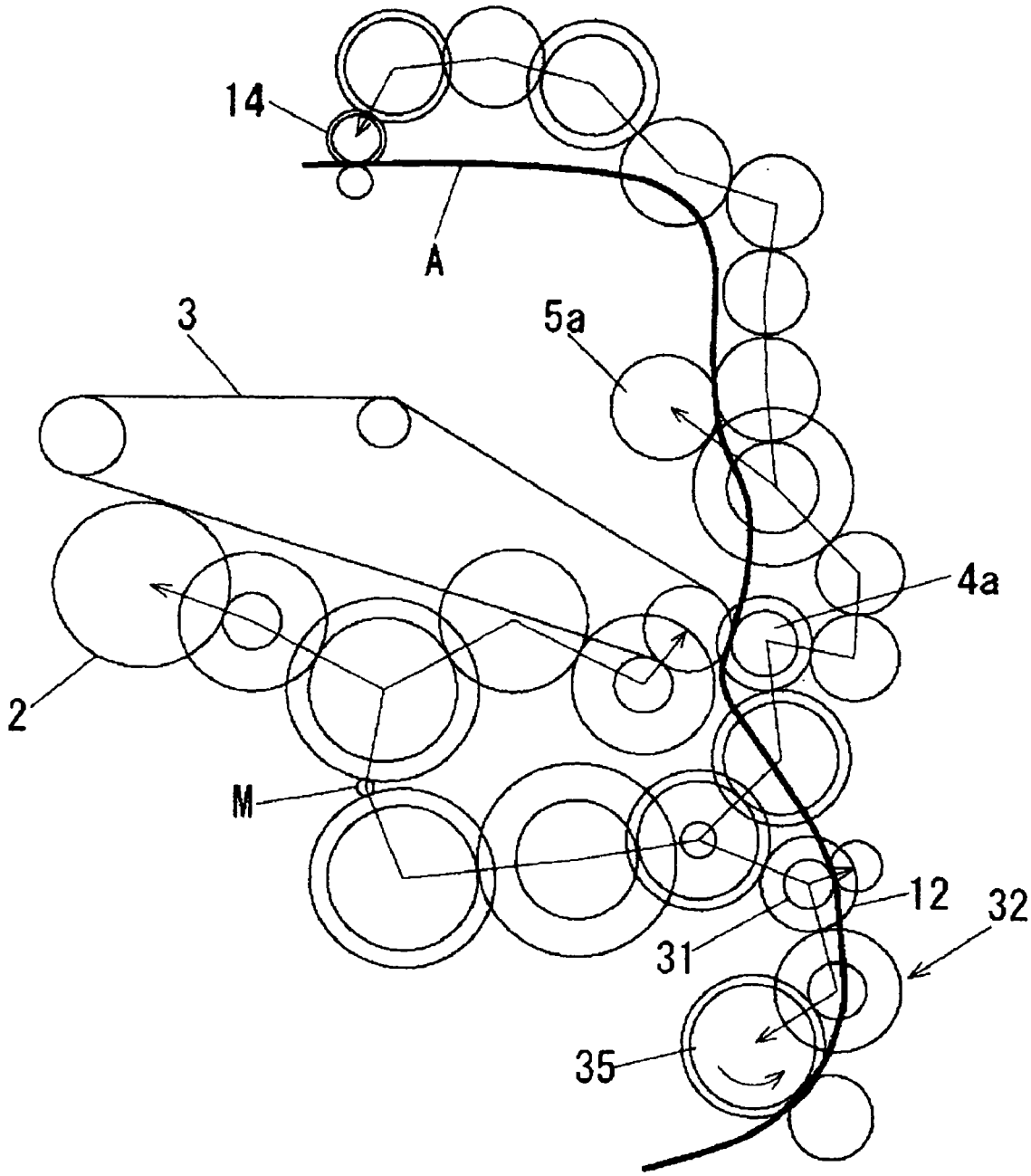
FIG. 15 is an explanatory view for explaining a gear array of the image forming apparatus according to the first embodiment of the invention.

FIG. 12A is a view for explaining the main part at time of a temporary stop of the paper feeding operation which is taken along the arrow of A-A in FIG. 2, FIG. 12B is a view for explaining the main part at time of the temporary stop of the paper feeding operation which is taken along the arrow of B-B in FIG. 2, and FIG. 12C is a view for explaining the main part at time of the temporary stop of the paper feeding operation which is taken along the arrow of C-C in FIG. 2. Furthermore, FIG. 13A is a view for explaining the main part after a restart of the paper feeding operation which is taken along the arrow of A-A in FIG. 2, FIG. 13B is a view for explaining the main part after the restart of the paper feeding operation which is taken along the arrow of B-B in FIG. 2, and FIG. 13C is a view for explaining the main part after the restart of the paper feeding operation which is taken along the arrow of C-C in FIG. 2. FIG. 14A is a view for explaining the main part immediately before an end of the paper feeding operation which is taken along the arrow of A-A in FIG. 2, FIG. 14B is a view for explaining the main part immediately before the end of the paper feeding operation which is taken along the arrow of B-B in FIG. 2, and FIG. 14C is a view for explaining the main part immediately before the end of the paper feeding operation which is taken along the arrow of C-C in FIG. 2. Furthermore, FIG. 15 is a view for explaining a gear array of the image forming apparatus according to the first embodiment of the invention.

The embodiment according to the invention will be described below with reference to the drawings. FIG. 1 shows an image forming apparatus such as a color printer using a rotary developing device. In FIG. 1, 1 denotes a body of the image forming apparatus and 2 denotes a photosensitive drum for forming an electrostatic latent image to be a visible image with a toner. The photosensitive drum 2 is a cylindrical member formed of aluminum, and a photosensitive layer such as an organic photosensitive member (OPC) is formed on a surface and shafts on both ends are rotated by a driving force of a motor (not shown). M shown in FIG. 15 denotes a motor gear of the motor, and a driving force for driving the photosensitive drum 2 is transmitted as one of a plurality of paths for branching and transferring a driving force of the motor gear M. This will be described below.

Moreover, 3 denotes an intermediate transfer belt onto which a visible image formed with the toner of the photosensitive drum 2 is transferred and is temporarily carried, and 4 denotes a transfer device for carrying out a second transfer over a recording paper during a delivery of the visible image of the intermediate transfer belt 3. The transfer device 4 is constituted by a transfer roller 4*a* and a backup roller 4*b*. The intermediate transfer belt 3 is laid over the backup roller 4*b*, and a visible image is transferred onto the recording paper by an action of an electric field of the transfer roller 4*a* to which a bias voltage having a positive polarity is applied.

5 denotes a fixing device for fixing the recording paper delivered after the transfer, 5*a* denotes a fixing roller constituting the fixing device 5, and 5*b* denotes a pressurizing roller disposed opposite to the fixing roller 5*a*. The visible image transferred by the transfer device 4 is fixed by the fixing roller 5*a* and the pressurizing roller 5*b*. A heat source such as a halogen lamp is provided in the fixing roller 5*a* and the toner is fused by heat and pressure and is thus fixed.

In FIG. 1, 6 denotes a rotary developing device for forming a visible image with toners having four colors of yellow (Y), magenta (M), cyan (C) and black (K). 6*a* denotes four developing rollers of the rotary developing device 6 which are provided for developing the respective toners having four colors of Y, M, C and K, and 6*b* denotes a developer for each color in which each developing roller 6*a* is provided. The developer 6*b* is provided with a stirring member. 6*c* denotes a toner bottle for supplying the toner for each color to the developer 6*b*, 6*d* denotes a supply roller and 6*e* denotes a rotating shaft of the rotary developing device 6.

The rotary developing device 6 is rotated around the rotating shaft 6*e* every 90 degrees in order to carry out color printing, and causes the developing roller 6*a* to be opposite to the photosensitive drum 2 and supplies any of the toners of Y, M, C and K to the photosensitive drum 2 every 90 degrees. When the four colors are supplied, a full-colored visible image is formed. When the printing is to be carried out, exposure and cleaning are performed with a laser beam every color and electrostatic latent images are formed on the photosensitive drum 2 in order of Y, M, C and K, and the respective visible images are transferred onto the intermediate transfer belt 3. Four rotations are repeated four times so that a full-colored visible image is formed on the intermediate transfer belt 3 on a superposing basis. The full-colored visible image of the intermediate transfer belt 3 is temporarily held, and is transferred onto the recording paper by the transfer roller 4*a* of the transfer device 4 when the intermediate transfer is ended. When the printing is to be carried out over one recording paper, accordingly, the rotary developing device 6 performs one rotation, the photosensitive drum 2 performs four rotations, the intermediate transfer belt 3 performs four rotations and the transfer roller 4*a* performs one rotation.

7 denotes a laser device for irradiating a laser beam in order to form an electrostatic latent image on the photosensitive drum 2 which is charged. The laser device 7 irradiates a laser beam to scan the photosensitive drum 2 based on an image signal sent from a PC (personal computer) or an image reading device which is not shown, thereby forming the electrostatic latent image. 8 denotes a charger for uniformly applying an electric charge onto the surface of the photosensitive drum 2.

Moreover, 9 denotes a cleaning blade provided around the photosensitive drum 2. The cleaning blade 9 scrapes off the residual toner on the photosensitive drum 2 after the intermediate transfer is carried out over the intermediate transfer belt 3. A toner collecting bottle 9*a* for collecting the toner scraped off by the cleaning blade 9 is provided by the side of the cleaning blade 9. The photosensitive drum 2 is rotated in a clockwise direction in FIG. 1, and the rotary developing device 6 and the intermediate transfer belt 3 are rotated in a counterclockwise direction which is reverse to the rotation of the photosensitive drum 2.

10 denotes a paper feed cassette for feeding the recording paper. It may be a tray. In FIG. 1, A denotes a delivery path along which the recording paper fed from the paper feed cassette 10 is delivered, transferred, fixed and then discharged. 11 denotes a paper feed roller taking a D-cut shape which serves to take out the recording paper and feed the recording paper to the delivery path A, and 11*a* denotes a backup roller. The recording paper taken out by the paper feed roller 11 is fed along the delivery path A. The paper feed roller 11 carries out one rotating intermittent operation to feed the recording papers one by one through a peripheral surface of the D-cut shape.

In the case in which a set position of the recording paper in the cassette is shifted longitudinally, however, there is a possibility that the recording paper might be delivered with a tip set in an oblique state. It is necessary to correct the skew. 12 denotes a resist roller for carrying out the correction by a resist method and 12*a* denotes a backup roller thereof. Moreover, 13 denotes a resist sensor for detecting the tip. In the resist method, the tip of the recording paper is caused to abut on a nip portion of the resist roller 13 while the resist roller 12 is stopped. In this state, furthermore, the recording paper is flexed by a delivering force of the paper feed roller 11 to correct the skew.

More specifically, the tip of the recording paper to be delivered along the delivery path A is detected by the resist sensor 13, and furthermore, the tip is caused to abut on the resist roller 12 during the stop. After the abutment, the delivering force is applied to the recording paper by means of the paper feed roller 11 so that the delivering force flexes the recording paper. By the flexure, the skew of the recording paper is corrected. Then, the resist roller 12 is rotated in such a timing that a predetermined time passes after the resist sensor 13 carries out the detection and the tip of the visible image and that of the recording paper are aligned with each other, and thus delivers the recording paper to the transfer device 4.

However, a time period required for the recording paper to reach the resist roller 12 has a great variation. When the recording paper arrives early, the amount of the flexure is excessively increased over the resist roller 12. For this reason, wrinkles, buckling and slips are generated over the recording paper. On the other hand, when the recording paper arrives late, the skew remains. In the first embodiment, in order to prevent them, the resist sensor 13 is waited to detect the tip, the rotation of the paper feed roller 11 is temporarily stopped when the tip is detected, and a variation is absorbed and the recording paper is then delivered. The details will be described below.

With reference to FIG. 1, the image forming apparatus will be further described. 14 denotes a paper discharge roller for discharging the recording paper subjected to the fixation, and 14*a* denotes a backup roller of the paper discharge roller 14. The recording paper which is delivered along the delivery path A and onto which a full-colored visible image is transferred by the transfer device 4 is fixed by the fixing device 5 and is discharged to a paper discharge cassette 20 by means of the paper discharge roller 14.

Next, the intermediate transfer belt 3 will be described. The intermediate transfer belt 3 is constituted by a rubber formed of a resin which has a thickness of approximately 0.1 mm and is excellent in an oil resistance, for example, and is laid over a plurality of rollers and a tension is applied in such a manner that the nip portion is a plane. 15 denotes a tension regulating roller energized by a spring from a back in order to apply a tension to the intermediate transfer belt 3, and 16 denotes a tension roller which maintains the nip portion to be a plane together with the transfer roller 4*a*. The tension roller 16 is provided with a cleaning unit for the intermediate transfer belt 3 which serves to remove the toner on the intermediate transfer belt 3 after the transfer. 17 denotes an intermediate transfer member cleaner to be the cleaning unit. The intermediate transfer member cleaner 17 includes a scraper for scraping off the toner remaining after the transfer onto the recording paper, and a toner collecting bottle for collecting the toner scraped off.

18 denotes a transfer roller which is provided opposite to the photosensitive drum 2 and serves to carry out the intermediate transfer. A bias voltage having a reverse polarity to the toner is applied to the transfer roller 18 in order to transfer the visible image formed on the photosensitive drum 2 onto the intermediate transfer belt 3. By the action of an electric field formed by the bias voltage, the visible image formed on the photosensitive drum 2 is transmitted onto the intermediate transfer belt 3. The intermediate transfer belt 3 onto which a full-colored visible image is transferred by four rotations for Y, M, C and K carries out a transfer onto the recording paper in the transfer device 4 when the intermediate transfer is ended. Accordingly, the bias voltage having the reverse polarity to the toner is also applied to the transfer roller 4*a*. The transfer roller 4*a* and the intermediate transfer cleaner 17 are constituted to be backward movable in such a manner that a distance from the intermediate transfer belt 3 can be maintained except for the time of the transfer.

Next, description will be given to an image forming process using the image forming apparatus shown in FIG. 1. In the image forming apparatus, a request for an output is received from an external connected PC (personal computer) or an image reading device and the image forming process is started based on an instruction given from a control portion (not shown). In the case of printing for four colors of Y, M, C and K, the developing roller 6*a* for Y is first rotated to an opposite position to the photosensitive drum 2. The photosensitive drum 2 is charged by the charger 8 and is then exposed by an image signal based on image information corresponding to Y with a laser beam emitted from the laser device 7 so that an electrostatic latent image is formed. Thereafter, a development is carried out by the developing roller 6*a* and a visible image for Y is then transferred onto the intermediate transfer belt 3. At this time, the transfer roller 4*a* and the scraper of the intermediate transfer member cleaner 17 are positioned apart from the intermediate transfer belt 3 and the visible image on the intermediate transfer belt 3 can be prevented from being scraped by the members.

The residual toner is scraped from the photosensitive drum 2 which completes the intermediate transfer for Y by means of the intermediate transfer member cleaner 17 and is rotated to the position of the charger 8 in order to carry out a next visible image formation. Then, the rotary developing device 6 is rotated by 90 degrees so that the developing roller 6*a* for M is rotated to the opposite position to the photosensitive drum 2. A visible image for the toner having the M color is formed from an electrostatic latent image exposed by the image signal based on image information about M by means of the laser device 7 and is superposed on the intermediate transfer belt 3. Similarly, visible images for the toners having the C and K colors are sequentially superposed on the intermediate transfer belt 3 and the intermediate transfer onto the intermediate transfer belt 3 is thus ended.

The transfer roller 4*a* is pushed out to a close position to the intermediate transfer belt 3 after the intermediate transfer of the visible image for C is ended and the visible image having the colors of C and others superposed thereon passes through the transfer device 4 and during the transfer of the visible image for the K color onto the intermediate transfer belt, and stands by in contact with the intermediate transfer belt 3. The scraper of the intermediate transfer member cleaner 17 is also pushed out before the toner remaining by the transfer onto the recording paper reaches an installing position after the end of the transfer of the visible image having the K color onto the intermediate transfer belt, and comes in contact with the intermediate transfer belt 3.

The recording paper onto which the full-colored visible image is transferred by the transfer device 4 is delivered to the fixing device 5 along the delivery path A. In the fixing device 5, the recording paper is heated by the fixing roller 5*a*, and is pressed and fixed by the pressurizing roller 5*b*. Thereafter, the recording paper fed along the delivery path A is discharged to the paper discharge cassette 20 by means of the paper discharge roller 14.

In the image forming apparatus according to the first embodiment, as described above, the rotation of the paper feed roller 11 is temporarily stopped before the recording paper reaches the resist roller 12, the tip of the recording paper is aligned and the paper feed roller 11 is then rotated again, and the resist roller 12 is rotated when a predetermined amount of flexure is obtained. Description will be given to a structure and an operation for implementing the rotation. FIG. 15 shows a gear array of a driving force transmitting system excluding the driving system of the rotary developing device 6.

As shown in FIG. 15, a driving force transmitted from the motor gear M of the motor is transmitted to the photosensitive drum 2 and the intermediate transfer belt 3 through an idle gear, and at the same time, to the transfer roller 4*a*, the fixing roller 5*a*, and the resist roller 12. The transmission of a torque using the gear array is carried out along a path shown in a plurality of branching broken lines in FIG. 15. The rotary developing device 6 is driven by means of another driving motor. For this reason, the details are not shown in FIG. 15. In FIGS. 2 to 7, 31 denotes a resist gear for rotating the resist roller 12 by the driving force transmitted from the motor gear M, and 32 denotes a planetary gear mechanism (see FIG. 4) to be driven by the rotation of the resist gear 31.

The resist gear 31 is removably coupled to the resist roller 12 through a resist clutch (not shown). The resist clutch rotates the resist roller in such a manner that timings of the tip of the image and that of the recording paper are matched with each other. For the resist clutch, it is possible to use an electromagnetic type clutch, a mechanical type clutch or any other clutch.

33 denotes an external gear (an external gear according to the invention) which is provided in the planetary gear mechanism 32, is engaged with the resist gear 31 and is disposed on an outer periphery of a carrier 41 of a planetary gear 39 which will be described below (see FIG. 4), and 34 denotes an output gear for rotating the paper feed roller 11 from the planetary gear mechanism 32. The output gear 34 is constituted to be integrally rotatable with an internal gear 37 to be mated with the planetary gear 39 (see FIGS. 4 and 5). Although the external gear 33 is used in the description of the first embodiment, the external gear according to the invention is not restricted to the external gear 33. The external gear according to the invention is not restricted to the external gear 33 if it is provided on a side surface (usually an outer periphery) of the carrier 41 on which at least a sun gear and the output gear 34 are not disposed and can be mated with the resist gear 31 in the planetary gear mechanism 32.

35 denotes a paper feed roller driving gear for rotating the paper feed roller 11, and 36 denotes a ratchet arm for engaging a ratchet 38 which will be described below (see FIGS. 4 and 7) or engaging the paper feed roller driving gear 35. The ratchet arm 36 is constituted by two dogleg-shaped arms which intersect each other at an obtuse angle, for example, approximately 100 to 160 degrees, and a first claw 36*a* and a second claw 36*b* are provided on tips of the respective arms. The first claw 36*a* serves to engage the ratchet 38 and the second claw 36*b* serves to stop the rotation of the paper feed roller driving gear 35.

With reference to FIGS. 4 to 7, next, detailed description will be given to a structure for transmitting the driving force sent from the motor gear M to the paper feed roller 11 and the resist roller 12. A resist clutch provided between the resist gear 31 and the resist roller 12 is not shown. In FIG. 4, 37 denotes an internal gear of the planetary gear mechanism 32 which is mated with the planetary gear 39 which will be described below and thus rotates the output gear 34 having a predetermined number of teeth. 38 denotes a ratchet which is provided on the sun gear of the planetary gear mechanism 32 (see FIG. 4) and can be rotated in only one direction. 39 denotes a planetary gear of the planetary gear mechanism 32. Two planetary gears 39 are provided in the first embodiment, and transmit, to the sun gear 43, a rotation input from the external gear 33 when the internal gear 37 and the sun gear 43 are mated with each other so that the rotation of the internal gear 37 is stopped, and transmit, to the internal gear 37, the rotation input from the external gear 33 when the rotation of the sun gear 43 is stopped.

The numbers of teeth of the gears have a relationship of (the number of teeth of the internal gear)=2×(the number of teeth of the planetary gear)+(the number of teeth of the sun gear). In the planetary gear mechanism 32, the planetary gear 39 revolves around the sun gear 43 when the sun gear 43 is brought into a rotation blocking state (a rotation disabling state) by the ratchet 38, and the planetary gear 39 rotates the internal gear 37 and the output gear 34 when a rotation is applied to the external gear 33. Consequently, the driving force of the driving motor is transmitted to the paper feed roller 11.

On the other hand, when the sun gear 43 is brought into a free rotating state (in which the ratchet 38 is separated from the ratchet arm 36), the planetary gear 39 freely rotates between the sun gear 43 and the internal gear 37 and thus rotates simply. Even if the rotation is applied to the external gear 33, therefore, the output gear 34 is not rotated. Thus, the transmission or non-transmission of the driving force in the planetary gear mechanism 15 is carried out depending on whether the sun gear 43 is brought into the rotation blocking state or the free rotating state by the action of the ratchet 38. When predetermined buckling is generated on the recording paper so that the amount of the flexure becomes constant after the resist sensor 13 detects the tip, the ratchet 38 is engaged with the ratchet arm 36 so that the paper feed roller 11 is rotated.

In FIG. 4, 40 denotes a rotating shaft of the planetary gear 39 which is provided on the external gear 33, 41 denotes a carrier of the planetary gear 39 which is provided on the external gear 33, and 42 denotes a rotating shaft provided on the carrier 41 and serving to pivotally support the external gear 33 together with the sun gear 43 and the internal gear 37. An opening facing the rotating shaft 40 and serving to mate the sun gear 43 with the planetary gear 39 is formed on the rotating shaft 42. 43 denotes a sun gear of the planetary gear mechanism 32. When the rotation is stopped by the ratchet 38 provided integrally with the sun gear 43, the driving force is transmitted from the resist gear 31 and the external gear 33 to the output gear 34 and the paper feed roller driving gear 35 so that the paper feed roller 11 is rotated. Even if the driving force is transmitted to the resist gear 31, the resist roller 12 is disconnected or connected independently of the paper feed roller 11 by means of a resist clutch. 45 in FIG. 5 denotes an internal tooth of the internal gear 37 which is formed on the internal gear 37 and is mated with the tooth of the planetary gear 39.

Referring to FIGS. 6 and 7, subsequently, description will be given to the paper feed roller driving gear 35. 44 denotes a solenoid to be an actuator for rocking the dogleg-shaped ratchet arm 36 around a rocking shaft on a center, and 44*a* denotes a solenoid arm for transmitting the operation of the solenoid 44 to the ratchet arm 36. When the solenoid 44 is excited, the solenoid arm 44*a* acts toward the first claw 36*a* side. Consequently, the first claw 36*a* is pushed down to stop the motion of the ratchet 38. At this time, the second claw 36*b* is lifted. An elastic member such as a spring is provided around the rocking shaft of the ratchet arm 36 to cause an elastic force to act between a fixed member (not shown) and the ratchet arm 36, and is energized to lift the first claw 36*a* and to push down the second claw 36*b* of the ratchet arm 36 when the excitation of the solenoid 44 is cut off.

Moreover, 46 denotes a boss provided around a rotating axis on a side surface of the paper feed roller driving gear 35, and 47 denotes a slit provided on the boss 46 (a first dent portion according to the invention). The boss 46 has an outer periphery taking a shape of a cam for permitting the push-down of the first claw 36*a* (at the same time, the lift of the second claw 36*b*) by a rocking operation for engaging the ratchet through the ratchet arm 36 and the push-down of the second claw 36*b* (at the same time, the lift of the first claw 36*a*) by a rocking operation for separating the ratchet.

In the shape, 48 denotes a lift surface to be a bulged portion which is formed to be larger than a reference radius around a rotating axis and serves to lift the second claw 36*b* (to push down the first claw 36*a*). Moreover, 49 denotes an offset bottom peripheral surface which is formed to be smaller than the reference radius and permits to push down the second claw 36*b* (a second dent portion according to the invention). The slit 47 is provided on the lift surface 48 in order to cause the paper feed roller 11 to be rotatable immediately after the start of the paper feeding operation. 50 denotes a step for a transition from the lift surface 48 to the offset bottom peripheral surface 49, and 51 denotes a transfer surface for getting over the lift surface 48 from the offset bottom peripheral surface 49 and smoothly separating the ratchet 38 without a shock.

A push-up force acts on the ratchet arm 36 because the lift surface 48 is bulged except for a portion of the slit 47 within a range of an angle of the boss 46 provided with the lift surface 48. Consequently, the engagement of the ratchet 38 can be maintained continuously. Shortly after the delivery of the recording paper is started in the paper feeding operation, however, it is desirable to continuously excite the solenoid 44 in order to reliably engage the ratchet 38. It is suitable that the offset bottom peripheral surface 49 should be formed around an opposed position to the slit 47 through the rotating axis of the boss 46. When the offset bottom peripheral surface 49 is disposed around the position, it is possible to maintain a maximum region in which the second claw 36*b* can be pushed down. Also in the case in which a time period required for the recording paper to reach the resist sensor 13 after the start of the paper feed, it is possible to maintain a state in which the second claw 36*b* is positioned on the offset bottom peripheral surface 49 for a long time (the second claw 36*b* enters the second dent). Consequently, it is possible to maintain a sufficient time period for stopping the paper feed roller 11. Thus, it is possible to temporarily stop the paper feed roller 11 reliably.

When the solenoid 44 is excited, the second claw 36*b* of the ratchet arm 36 is lifted and slips out of the slit 47 of the boss 46 so that the first claw 36*a* on an opposite side is engaged with the ratchet 38. Consequently, the rotation of the sun gear 43 of the planetary gear mechanism 32 is stopped and the internal gear 37, the output gear 34 and the paper feed roller driving gear 35 are rotated so that the paper feed roller 11 is rotated.

When the resist sensor 13 detects the tip of the recording paper, then, the solenoid 44 is released from the exciting state and the ratchet arm 36 is rotated in an opposite direction by the energizing force so that the first claw 36*a* is lifted and the ratchet 38 is thus disengaged. Consequently, the sun gear 43 is brought into the free rotating state so that the output gear 34 and the paper feed roller driving gear 35 can be prevented from being rotated even if the rotation is applied from the external gear 33.

At this time, the offset bottom peripheral surface 49 is formed on the boss 46. Therefore, the second claw 36*b* of the ratchet arm 36 is pushed down within a range of the offset bottom peripheral surface 49 to be the groove portion of the boss 46 if any. Thus, the second claw 36*b* simply abuts on the surface so that the first claw 36*a* is permitted to be lifted and the engagement and disengagement of the ratchet 38 through the ratchet arm 36 can be prevented from being disturbed. In the case of the first embodiment, the second claw 36*b* is energized by the energizing force of the elastic member in an abutting state on the offset bottom peripheral surface 49.

When the control portion excites the solenoid 44 in this state, the first claw 36*a* of the ratchet arm 36 is engaged with the ratchet 38. Consequently, the rotation of the sun gear 43 is stopped and the internal gear 37, the output gear 34 and the paper feed roller driving gear 35 are rotated so that the paper feed roller 11 is rotated. The amount of flexure of the recording paper reaches a predetermined amount and the control portion connects the resist clutch in a predetermined timing synchronized with the operation of the intermediate transfer belt 3. Consequently, the driving force is transmitted from the resist gear 31 to the resist roller 12 so that the resist roller 12 starts a rotation.

Even if the control portion stops the excitation of the solenoid 44, thereafter, the second claw 36*b* of the ratchet arm 36 is rotated to a position of the lift surface 48 from the transition surface 51. The second claw 36*b* is continuously maintained to get over the lift surface 48 and the first claw 36*a* is continuously maintained to be engaged with the ratchet 38. When the paper feed roller 11 carries out a rotation, the second claw 36*b* enters the slit 47 so that the paper feeding operation is ended.

After the paper feed roller 11 carries out a rotation, the transmission of the driving force from the resist gear 31 to the resist roller 12 is continuously carried out while the recording paper passes by the resist clutch and the transfer is performed by the transfer device 4. The connection of the resist clutch is released in a predetermined timing after the resist sensor 13 detects a rear end of the recording paper. Consequently, the rotation of the resist roller 12 is stopped.

With reference to FIGS. 8 to 15, therefore, detailed description will be given to an operation of the paper feed roller 11 and the resist roller 12 and a structure for executing the operation. FIG. 8 is a time chart showing the paper feeding mechanism according to the first embodiment of the invention, FIG. 9A is a view showing the main part taken along the arrow of A-A in FIG. 2, FIG. 9B is a view showing the main part taken along the arrow B-B in FIG. 2, and FIG. 9C is a view showing the main part taken along the arrow of C-C in FIG. 2. As shown in FIG. 8, a state before a start of the paper feeding operation is set in a timing of to, and states shown in FIGS. 9A, 9B and 9C are brought.

At this time, as shown in FIG. 9A, the second claw 36*b* is engaged with the slit 47 and the first claw 36*a* is disconnected from the ratchet 38 so that the sun gear 43 is brought into the free rotating state and the driving force sent from the resist gear 31 is not transmitted to the internal gear 37, the output gear 34 and the paper feed roller driving gear 35. As shown in FIG. 9B, moreover, the solenoid 44 is OFF and the ratchet arm 36 is brought into an engaging state with the boss 46. As shown in FIG. 9C, the resist roller 12 is stopped and the resist sensor 13 is set in an OFF state.

When the solenoid 44 is excited (ON) in a timing of $t_1$ in FIG. 8, however, the paper feeding operation is started. As shown in FIG. 10A, the second claw 36*b* of the ratchet arm 36 is lifted and is thus disconnected from the slit 47 of the boss 46 and the first claw 36*a* on an opposite side is engaged with the ratchet 38. Consequently, the sun gear 43 cannot be rotated and the internal gear 37, the output gear 34 and the paper feed roller driving gear 35 are rotated so that the paper feed roller 11 is rotated.

At this time, as shown in FIG. 10B, the solenoid 44 is ON, the ratchet 38 is engaged and the sun gear 43 is brought into a stopping state, and the internal gear 37, the output gear 34 and the paper feed roller driving gear 35 are rotated so that the paper feed roller 11 is rotated. As shown in FIG. 10C, however, the resist roller 12 is maintained to be stopped and the resist sensor 13 is set in the OFF state. The recording paper is slightly delivered by the rotation of the paper feed roller 11.

Then, the recording paper is delivered, and the second claw 36*b* of the ratchet arm 36 is placed in a position of the offset bottom peripheral surface 49 immediately before a timing of $t_2$ in FIG. 8 and the tip of the recording paper is set in a state immediately before an arrival by the resist sensor 13. FIGS. 11A, 11B and 11C show the state. They are identical to FIGS. 10A, 10B and 10C except for the rotating position of the boss 46 in FIG. 11B and the tip position of the recording paper in FIG. 11C.

The resist sensor 13 detects the tip of the paper in the timing of $t_2$. When the resist sensor 13 is turned ON, the solenoid 44 is non-excited (OFF), the ratchet arm 36 is rocked in an opposite direction and the ratchet 38 is disengaged. Consequently, the sun gear 43 is brought into the free rotating state. Even if a rotation is applied from the external gear 33, the output gear 34 and the paper feed roller driving gear 35 are not rotated and the paper feed roller 11 is not rotated. At this time, the second claw 36*b* of the ratchet arm 36 is positioned on the offset bottom peripheral surface 49 and the rotation of the ratchet arm 36 is not disturbed and the second claw 36*b* does not disturb the operation of the paper feed roller 11.

FIG. 12A shows a state in which the output gear 34 and the paper feed roller driving gear 35 are stopped because the sun gear 43 can be freely rotated even if the driving force of the resist gear 31 rotates the external gear 33 when the resist sensor 13 is turned ON. Moreover, FIG. 12B shows a state in which the solenoid 44 is OFF, the sun gear 43 is set in the free rotating state and the rotation of the paper feed roller 11 is stopped, and FIG. 12C shows a state in which the resist roller 12 is maintained to be stopped even if the resist sensor 13 is turned ON.

Subsequently, the solenoid 44 is excited in a timing of $t_3$ in FIG. 8 and the rotation of the paper feed roller 11 is restarted, and the resist clutch is turned ON in a timing of $t_4$ in which a predetermined time passes from $t_3$. FIGS. 13A, 13B and 13C show this state. In this state, the first claw 36*a* of the ratchet arm 36 is engaged with the ratchet 38. Accordingly, the sun gear 43 is not rotated, the internal gear 37, the output gear 34 and the paper feed roller driving gear 35 are rotated, and the paper feed roller 11 is rotated. At this time, as shown in FIG. 13B, the solenoid 44 is ON, the ratchet 38 is set in an engaging state, the sun gear 43 is stopped, the internal gear 37, the output gear 34 and the paper feed roller driving gear 35 are rotated, and the paper feed roller 11 is rotated. As shown in FIG. 13C, the resist clutch is turned ON so that the resist roller 12 starts a rotation.

In the image forming apparatus according to the first embodiment, even if the time period required for the recording paper to reach the position of the resist sensor 13 has a variation, it is possible to absorb the variation in the timings of $t_2$, $t_3$ and $t_4$. More specifically, even if $t_2$ has a variation, the paper feeding operation is stopped till the time of $t_3$. On at least $t_3$, there is implemented a state in which the tip of the recording paper is present in the position of the resist sensor 13. $t_4$ is a timing obtained after the passage of a predetermined time since $t_3$. Even if the delivery of the recording paper has a variation, it is possible to always form an optimum flexure in a certain amount on the recording paper, thereby correcting a skew. Therefore, wrinkles, buckling and slip sounds are not generated on the recording paper. Consequently, it is possible to maintain an excellent recording paper delivering property.

For the timing of $t_3$, it is preferable to select a point where the variation in $t_2$ generated in the delivery of the recording paper, that is, the variation in the time period required for the recording paper to arrive. For the timing of $t_4$, moreover, it is preferable to set a point wherein the recording paper reaches the position of the resist roller 12 from the position of the resist sensor 13, and furthermore, a certain amount of flexure can be formed. Accordingly, the timing of $t_4$ is determined depending on the delivery speed of the paper feed roller 11 and the amount of the flexure to be formed.

Then, the recording paper is delivered so that the solenoid 44 is non-excited in a timing of $t_5$ in FIG. 8. As shown in FIG. 14B, the second claw 36*b* of the ratchet arm 36 is present on the lift surface 48 of the boss 46 and the first claw 36*a* is maintained to be engaged with the ratchet 38. The paper feed roller 11 continuously carries out the rotation until the second claw 36*b* reaches the position of the slit 47 and stops the rotation on $t_6$ that the second claw 36*b* reaches the position of the slit 47. In the timing of $t_6$, the paper feed roller 11 started at $t_1$ carries out one rotation so that one recording paper is completely delivered.

In the timing of $t_5$ in which the solenoid 44 is non-excited, it is required that a relationship of a time period taken for the paper feed roller 11 to carry out a rotation> a total ON time period of the solenoid, that is, $(t_2-t_1)+(t_6-t_3)>(t_2-t_1)+(t_5-t_3)$ can be obtained. By meeting the relationship, the paper feed roller 11 can be rotated by the action of the solenoid 44 (even if a push-up action of the lift surface 48 is applied on a superposing basis or not) in a time zone in which at least the solenoid 44 is excited, and the lift surface 48 engages the first claw 36*a* to rotate the paper feed roller 11 in place of the solenoid 44 in a time zone in which the solenoid 44 is not excited. A total time period in which the solenoid 44 is ON is set to be shorter than a time period required for the paper feeding operation. When the operating time period is exceeded, the paper is fed by the lift surface 48. Therefore, a power is not wasted so that energy saving can be obtained. When the paper feed roller 11 carries out a rotation, it is hard to carry out a control for inserting the second claw 36*b* into the slit 47 on a software basis by only the solenoid 44. By the rotation of the paper feed roller 11, however, the second claw 36*b* is pushed up by the lift surface 48, and then, can be physically dropped into the slit 47. As compared with the control on a software basis, the paper feeding operation can be controlled more easily without a malfunction.

FIGS. 14A, 14B and 14C show a state in which the second claw 36*b* is present on the lift surface 48 of the boss 46. At this time, as shown in FIG. 14B, the solenoid 44 is OFF, the ratchet 38 is set in the engaging state, the sun gear 43 is stopped, and the internal gear 37, the output gear 34 and the paper feed roller driving gear 35 are rotated. At this time, the resist clutch is maintained to be connected as shown in FIG. 14C and the rotation of the resist roller 12 is continuously carried out.

When the recording paper is further delivered and the resist sensor 13 detects the rear end of the recording paper at a time of $t_7$ in FIG. 8, the resist sensor 13 is turned OFF and a time period required for the rear end to completely pass through the resist roller 12 is counted by a timer which is not shown, and the resist clutch is turned OFF by the control portion at a time of $t_8$. Consequently, the rotation of the resist roller 12 is stopped at $t_8$. Therefore, it is preferable that the timing of $t_8$ should be obtained by adding, to $t_7$, at least a time period required for the recording paper to reach the position of the resist roller 12 from the position of the resist sensor 13.

In the image forming apparatus according to the first embodiment, thus, even if a recording paper arriving time period for delivering the recording paper to the resist sensor is varied due to a longitudinal shift of a position in the cassette in which the recording paper is set, it is possible to accurately form a flexure in a predetermined amount on the recording paper, thereby correcting a skew. Therefore, wrinkles, buckling and slips are not generated on the recording paper. Thus, it is possible to maintain an excellent recording paper delivering property.

The present application is based upon and claims the benefit of priority of Japanese Patent Application No. 2006-271513 filed on Oct. 3, 2006, the content of which is incorporated herein by references in its entirety.

What is claimed is:

1. An image forming apparatus comprising:

a resist roller for aligning a printing start position timing with a position of a tip of a recording paper;

a paper feed roller for feeding the recording paper to the resist roller;

a resist sensor for detecting the tip of the recording paper fed on a upstream side of the resist roller;

a resist gear for transmitting a rotating force from a driving motor to the resist roller;

an external gear to which a rotating force of the resist gear is transmitted;

an internal gear positioned coaxially with the external gear and serving to transmit a rotating force from the external gear to the paper feed roller;

a paper feed roller driving gear mated with the internal gear to rotate the paper feed roller;

a ratchet positioned coaxially with the internal gear and serving to transmit a rotation of the external gear to the internal gear or to release the transmission of the rotation;

a ratchet arm having a first claw engaged with the ratchet to transmit the rotation of the external gear to the internal gear, thereby rotating the paper feed roller, and a second claw engaged with a first dent portion provided on a boss of the paper feed roller driving gear to turn the paper feed roller toward a rotation start position and to remove the first claw from the ratchet, thereby stopping the rotation of the paper feed roller; and a second dent portion provided with the boss of the paper feed roller driving gear, the second claw entering the second dent portion and moving within the second dent portion, thereby stopping the rotation of the paper feed roller when the resist sensor detects the tip of the recording paper before the paper feed roller carries out one rotation.

2. The image forming apparatus according to claim 1, wherein the boss of the paper feed roller driving gear has a bulged portion for pushing up the second claw between the first dent portion and the second dent portion, the second claw is pushed up by the bulged portion through the rotation of the paper feed roller and enters the first dent portion when the second claw slips out of the second dent portion, and the first claw slips out of the ratchet to stop the rotation of the paper feed roller according to the entrance of the second claw into the first dent portion.

3. The image forming apparatus according to claim 1, wherein a planetary gear mechanism is constituted by a sun gear and a planetary gear which include the external gear, the internal gear and the ratchet.

4. The image forming apparatus according to claim 1, further comprising a solenoid for pushing up the first claw and separating the first claw from the ratchet by an excitation of the solenoid to be turned OFF when the resist sensor detects the tip of the recording paper, and for dropping the second claw into the second dent portion when the first claw is separated from the ratchet.

5. The image forming apparatus according to claim 4, wherein a total time period for which the solenoid is excited is set to be shorter than a time period for which a paper feeding operation is carried out by the paper feed roller.

6. The image forming apparatus according to claim 1, wherein the second dent portion is formed around an opposed position to the first dent portion through a shaft portion of the boss of the paper feed roller driving gear.

7. The image forming apparatus according to claim 1, wherein the ratchet arm is provided with an elastic member to be energized for applying a rotating force toward the boss of the paper feed roller, and the second claw abuts on the second dent portion by an energizing force of the elastic member and the second claw is moved toward the first dent by a rotation of the boss.

8. A paper feeding method in an image forming apparatus, the image forming apparatus including a resist roller for aligning a printing start position timing with a position of a tip of a recording paper, a paper feed roller for feeding the recording paper to the resist roller, a resist sensor for detecting the tip of the recording paper fed on a upstream side of the resist roller, a resist gear for transmitting a rotating force from a driving motor to the resist roller, an external gear to which a rotating force of the resist gear is transmitted, an internal gear positioned coaxially with the external gear and serving to transmit a rotating force from the external gear to the paper feed roller, a paper feed roller driving gear mated with the internal gear to rotate the paper feed roller, a ratchet positioned coaxially with the internal gear and serving to transmit a rotation of the external gear to the internal gear or to release the transmission of the rotation, a ratchet arm having a first claw engaged with the ratchet to transmit the rotation of the external gear to the internal gear, thereby rotating the paper feed roller, the ratchet arm having a second claw engaged with a first dent portion provided on a boss of the paper feed roller driving gear to turn the paper feed roller toward a rotation start position and to remove the first claw from the ratchet, thereby stopping the rotation of the paper feed roller; and a second dent portion provided with the boss of the paper feed roller driving gear, the method comprising:

entering the second claw into the second dent portion;

moving the second claw within the second dent portion; and stopping the rotation of the paper feed roller when the resist sensor detects the tip of the recording paper before the paper feed roller carries out one rotation.

* * * * *